US005135412A

United States Patent [19]

Sitzler

[11] Patent Number: 5,135,412

[45] Date of Patent: Aug. 4, 1992

[54] HOLD-DOWN TERMINAL

[75] Inventor: Fred C. Sitzler, Dillsburg, Pa.

[73] Assignee: E. I. du Pont de Nemours and Company, Wilmington, Del.

[21] Appl. No.: 647,643

[22] Filed: Jan. 29, 1991

[51] Int. Cl.[5] ..... H01R 13/73

[52] U.S. Cl. ..... 439/571; 439/567

[58] Field of Search ..... 439/82, 552–555, 439/557, 567, 571, 733, 751

[56] References Cited

U.S. PATENT DOCUMENTS

| | | | |
|---|---|---|---|
| 3,902,777 | 9/1975 | Anhalt et al. | 339/17 |
| 4,220,393 | 9/1980 | Ammon et al. | 439/733 |
| 4,619,495 | 10/1986 | Sochor | 439/751 |
| 4,645,287 | 2/1987 | Olsson | 339/125 |
| 4,681,389 | 7/1987 | Nakazawa et al. | 439/557 |
| 4,735,587 | 4/1988 | Kirayogin | 439/82 |
| 4,907,987 | 3/1990 | Douty et al. | 439/571 |
| 4,993,975 | 2/1991 | Asick et al. | 439/751 |
| 5,044,988 | 9/1991 | Hirayama | 439/571 |

FOREIGN PATENT DOCUMENTS

| | | | |
|---|---|---|---|
| 1408761 | 7/1965 | France | 439/746 |

*Primary Examiner*—Gary F. Paumen

*Attorney, Agent, or Firm*—John E. Griffiths

[57] ABSTRACT

The present invention relates to hold-downs for securing components to circuit assemblies and more particularly to hold-down terminals for securing connectors to printed circuit boards.

18 Claims, 6 Drawing Sheets

HOLD-DOWN TERMINAL

BACKGROUND OF THE INVENTION

1. Field of the Invention

This invention relates to hold-downs for securing components to circuit assemblies and more particularly to hold-down terminals for securing connectors to printed circuit boards.

2. Description of Related Art

Various apparatus exist for locating and securing connectors onto printed circuit boards (PCBs) prior to and during soldering of electrical terminals mounted in the connector to the circuit assembly.

For instance, U.S. Pat. No. 4,735,587 discloses a header with two rows of pins with selected opposed pin pairs having cantilever retention arms for engaging interior surfaces of circuit board holes to hold the header to a circuit board prior to and during soldering. The pins are held in the board holes merely by the interference fit between linear corners or edges of the pins against the wall of the board holes. The particular shape and orientation of the retention arms results in the need for a relatively high insertion force in order to press the pin into a hole.

U.S. Pat. No. 4,907,987 discloses a boardlock for mounting a connector to a printed circuit board. A first portion of the boardlock is secured by an interference fit within a recess in the connector housing. Tabs define shoulders on the boardlock which prevent the housing from being separated from the boardlock. A pair of spring members extend from the first portion for insertion into a hole through the circuit board. Barbs on opposed surfaces of the spring members bite into the wall of the hole forming an interference fit between the boardlock and the circuit board. However, the retention force caused by the interference fit between this hold-down in a connector housing is low which may necessitate the use of a special seating tool to connect such a hold-down to a board.

It is an object of this invention to provide a hold-down terminal that can be used to hold down a connector on a printed circuit board at least while terminals mounted in the connector are soldered to the circuit board.

It is an object of this invention to provide the hold-down terminal such that it can be used to hold down either a through-mount connector or a surface mount connector onto a printed circuit board.

These and other objects of the invention will be clear from the following description.

SUMMARY OF THE INVENTION

This invention relates to a hold-down terminal for holding a connector housing to a circuit assembly. The housing has a mounting face and a hold-down receiving space recessed in the mounting face. The space is partially defined by a shoulder surface generally parallel to the mounting face. The hold-down terminal comprises a housing attaching portion having a spring member with a first edge surface. When the housing attaching portion is inserted in the space recessed in the housing, the housing compresses the spring member until the end surface springs onto the shoulder surface partially defining the space. The hold-down terminal further comprises a circuit assembly attaching portion for securing to the circuit assembly. The hold-down terminal further comprises a stand-off between the housing attaching portion and the circuit assembly attaching portion. The stand-off has opposed surfaces for facing the housing and the circuit assembly. The stand-off is for ensuring a space between the housing and the circuit assembly to limit wicking during soldering and to allow cleaning..

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
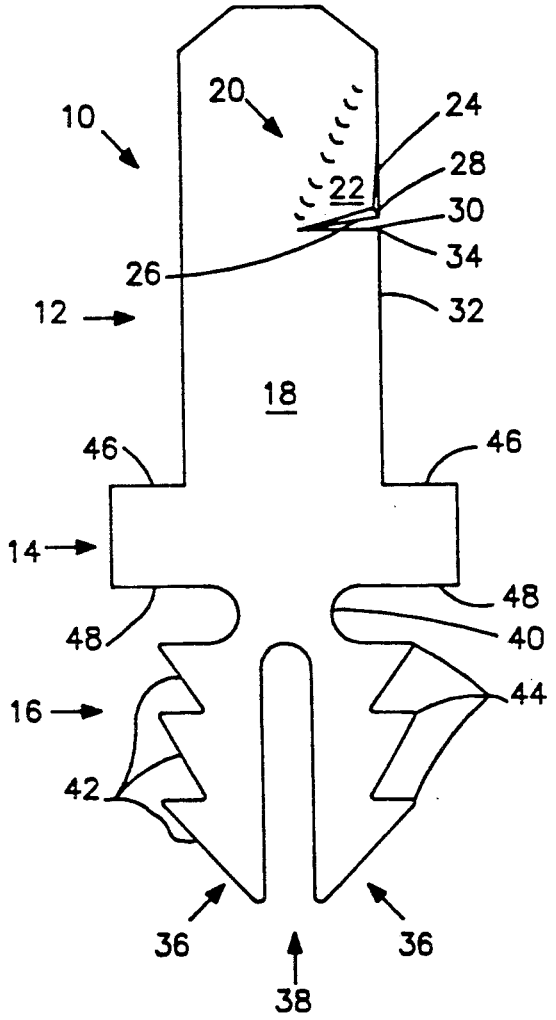
FIG. 1 is a side view of a first embodiment of a hold-down terminal in accordance with the present invention.

Throughout the following detailed description, similar reference characters refer to similar elements in all figures of the drawings.

Figure 2:
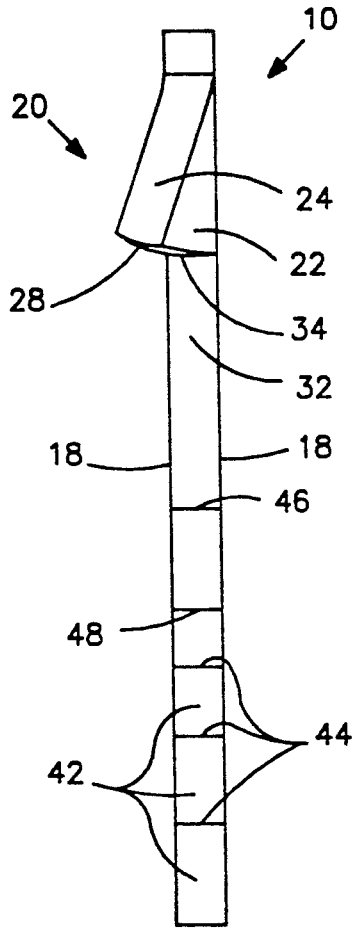
FIG. 2 is an edge view of the hold-down terminal of FIG. 1.

Referring to FIG. 1, there is illustrated a side view of a first embodiment of a hold-down terminal 10 in accordance with the present invention. FIG. 2 is an edge surface view of the hold-down terminal 10 of FIG. 1.

The hold-down terminal 10 is for holding a connector housing to a circuit assembly. The term "circuit assembly" is intended to include any assembly that includes a plurality of conductors, leads, plated through holes or conductive paths, pads or areas. The circuit assembly can be a printed wiring board or a printed circuit board, such as a backpanel, a mother board or a daughter board. The circuit assembly can be rigid or flexible.

The hold-down terminal 10 comprises a housing attaching portion 12, a circuit assembly attaching portion 16 and a stand-off 14 between the housing attaching portion 12 and the circuit assembly attaching portion 16. The housing attaching portion 12, the circuit assembly attaching portion 16 and the stand-off 14 are preferably made from a single or one piece of material. They can be made from a single strip of metal defined by a pair of opposing sides 18 interconnected by edge surfaces.

The housing attaching portion 12 has a spring member 20 entirely defined by areas 22 of the pair of opposing sides 18, a first edge surface 24 and a second edge surface 26. The first edge surface 24 and the second edge surface 26 interconnect the opposing side areas 22. The first edge surface 24 intersects the second edge surface 26 forming a first corner 28. In a noncompressed state, the first corner 28 extends generally laterally with respect to the remainder of the hold-down 10. In other words, the opposing side areas 22 are bent with respect to the remainder of the opposing sides 18. The housing attaching portion 12 has a third planar edge surface 30 intersecting a fourth planar edge surface 32 forming a second corner 34. In a compressed state where the opposing side areas 22 are forced to substantially be coplanar with the remainder of the opposing sides 18, then (1) the second edge surface 26 faces the third edge surface 30 and (2) the first edge surface 24 and the fourth edge surface 32 are coplanar and arranged end to end. When the housing attaching portion 12 is inserted in a space partially defined by a shoulder surface recessed in a connector housing, the housing compresses the spring member 20 until the second edge surface 26 springs onto the shoulder surface. One of the side areas 22 of the spring member 20 comprises an easy insertion ramp for sliding against the housing when inserted into the hold-down receiving space. The second edge surface 26 in contact with the shoulder surface prevents withdrawal of the hold-down 10 from the housing space until the spring member 20 is compressed such as by a screw driver or other similar tool forced into the space on the shoulder surface adjacent the spring member 20. By this action, the housing attaching portion 12 is easily removed from the housing so the connector can be replaced or repairs can be performed.

A single cut or shear can form both the second edge surface 26 and the third edge surface 30. Alternatively, a slug of material can be punched or stamped out forming the second edge surface 26 facing the third edge surface 30 across a gap. Then the opposing side areas 22 are bent or molded to the shape of the desired spring member 20.

The circuit assembly attaching portion 16 is for securing to the circuit assembly. The circuit assembly attaching portion 16 can be described as generally having a shape of a Christmas tree. The circuit assembly attaching portion 16 comprises a pair of spring members 36 generally parallel to one another and spaced entirely apart by a slot 38. The spring members 36 are the branches of the Christmas tree. The spring members 36 are connected together at and extend from the stand-off 14. This connection of the spring members 36 to the stand-off 14 resembles a trunk 40 of the Christmas tree. The spring members 36 have outer edge surfaces comprising easy insertion ramps 42 with barbs 44 at outer ends of the ramps 42 such that the ramps 42 allow easy insertion into a hole through the circuit assembly forming an interference fit in the assembly hole. However, the barbs 44 dig into the circuit assembly if the hold-down terminal 10 is withdrawn from the hole. The barbs 44 resemble the ends of the branches of the Christmas tree.

The stand-off 14 has opposed surfaces 46,48 for facing the housing and the circuit assembly. The stand-off 14 is for ensuring a space between the housing and the circuit assembly to limit wicking during soldering and to allow cleaning. One 46 of the opposing surfaces 46,48 of the stand-off 14 provides a stop for contacting the housing and preventing further insertion of the hold-down terminal 10 into the hold-down receiving space.

The opposing sides 18 of the housing attaching portion 12, the circuit assembly attaching portion 16 and the stand-off 14 are entirely in a pair of parallel planes, except for the opposing side areas 22 of the spring member 20 when in a noncompressed state. When the spring member 20 is in a compressed state, the opposing side areas 22 are substantially in the parallel planes with the remainder of the opposing sides 18.

Referring to FIGS. 3–6, there is illustrated a second embodiment of a hold-down terminal 110 in accordance with the present invention. The second hold-down terminal 110 is the same as the first hold-down terminal 10, except the second hold-down terminal 110 has a housing attaching portion 112 that is different than the housing attaching portion 12 of the first hold-down terminal 10.

Figure 6:
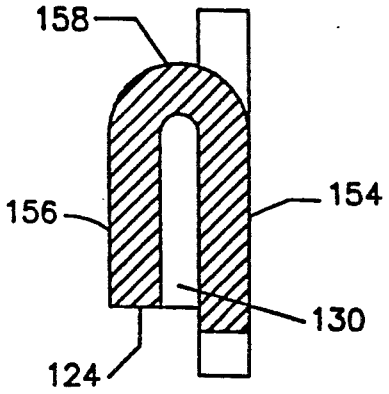
FIG. 6 is a cross sectional view taken along line 7—7 in FIG. 5 generally in the direction of the arrows.

The housing attaching portion 112 comprises a flat strip having a first side 150 and a second side 152 folded upon itself forming a first portion 154, a second portion 156 and an elbow portion 158 interconnecting the first portion 154 and the second portion 156. The second portion 156 comprises a first section 160 and a second section 162. The first section 160 includes a spring member 120 entirely defined by areas 122 of the first and second sides 150,152, a first edge surface 124 and a second edge surface 126. The first edge surface 124 and the second edge surface 126 interconnect the side areas 122. The first edge surface 124 intersects the second edge surface 126 forming a first corner 128. The housing attaching portion 112 has a third planar edge surface 130 intersecting a fourth planar edge surface 132 forming a second corner 134. The first, second, third and fourth edge surfaces 24,26,30,32 are configured and function similar to the first, second, third and fourth edge surfaces 124,126,130,132, respectively. Similarly, the first and second side areas 122 of the spring member 120 are configured and function similar to the side areas 22 of the spring member 20. The first side 150 of the first portion 154 substantially contacts the first side 150 of the second portion 156 except the second edge 126 extends away from the first portion 154 forming a protruding end surface of the spring member 120. Referring to FIG. 6, the second end surface 126 of the spring member 120 has a substantially U shaped cross section in its noncompressed state. The outer side area 122 of the spring member 120 comprises an easy insertion ramp for sliding against the housing when being inserted into the hold-down receiving space recessed in the mounting face of the connector housing.

Figure 7:
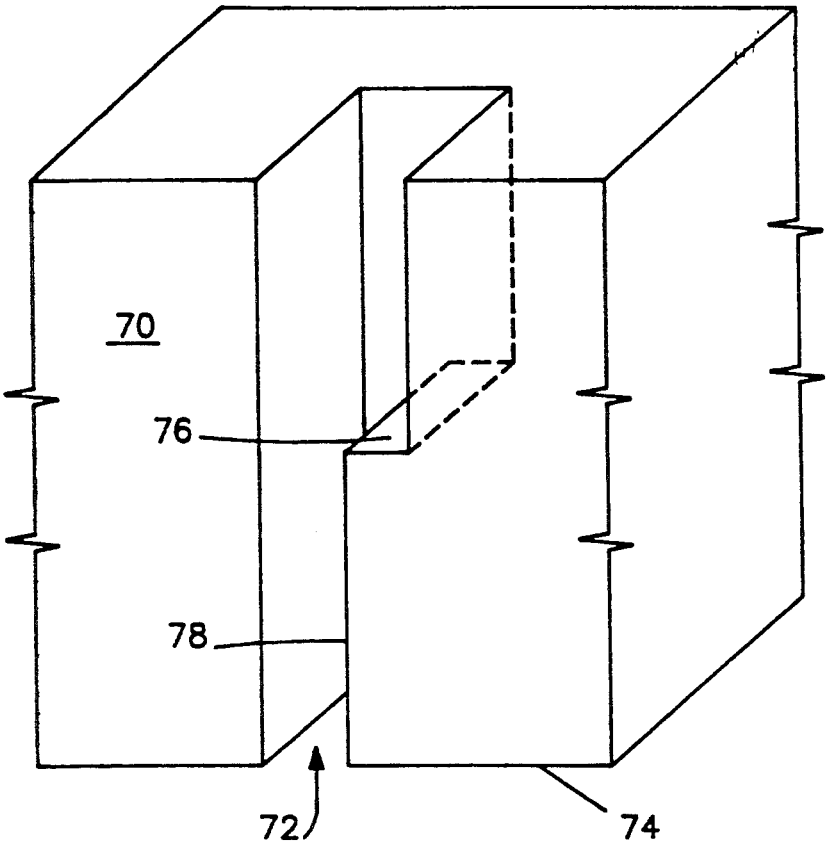
FIG. 7 is a first embodiment of a cross sectional view of a section of a connector housing having a hold-down receiving space for receiving the hold-down terminal of FIG. 1 in accordance with the present invention.

FIG. 7 is a first embodiment of a cross sectional view of a section of a connector housing 70 having a hold-down receiving space 72 for receiving the hold-down terminal 10 of FIG. 1 in accordance with the present invention. The housing 70 is made of a dielectric material. It has a mounting face 74 and the hold-down receiving space 72 is recessed in the mounting face 74. The space 72 is partially defined by a shoulder surface 76 generally parallel to the mounting face 74. In this embodiment, the shoulder surface 76 extends the entire width of the space 72. This shoulder surface 76 can be described as the top surface of a step which has only one other surface 78 exposed or partially defining the space 72.

Figure 3:
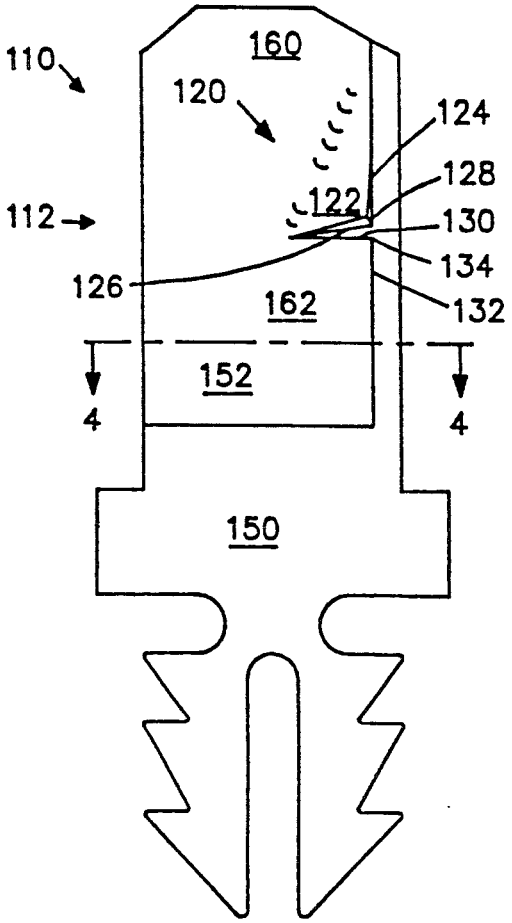
FIG. 3 is a side view of a second embodiment of a hold-down terminal in accordance with the present invention.
Figure 5:
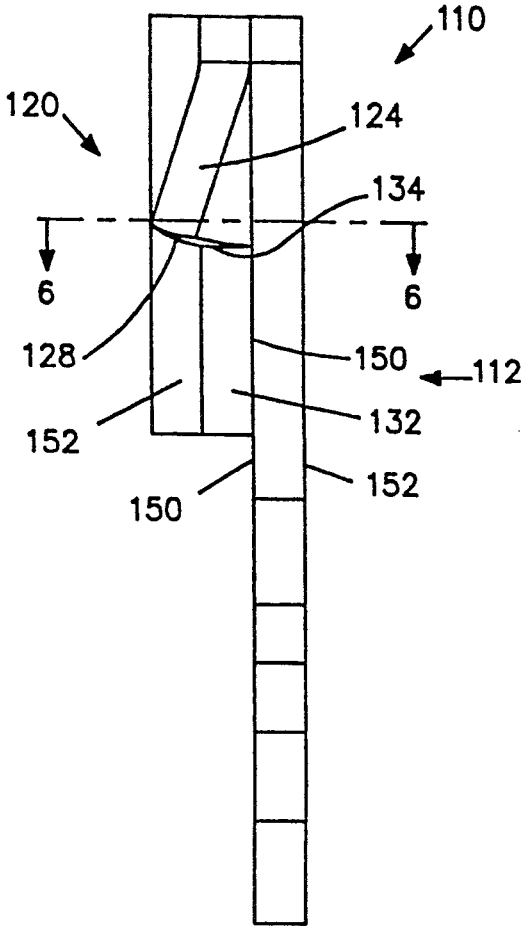
FIG. 5 is an edge view of the hold-down terminal of FIG. 3.
Figure 4:
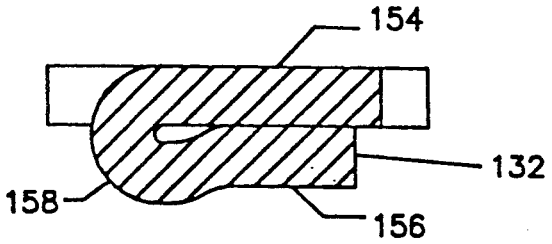
FIG. 4 is a cross sectional view taken along line 5—5 in FIG. 3 generally in the direction of the arrows.
Figure 8:
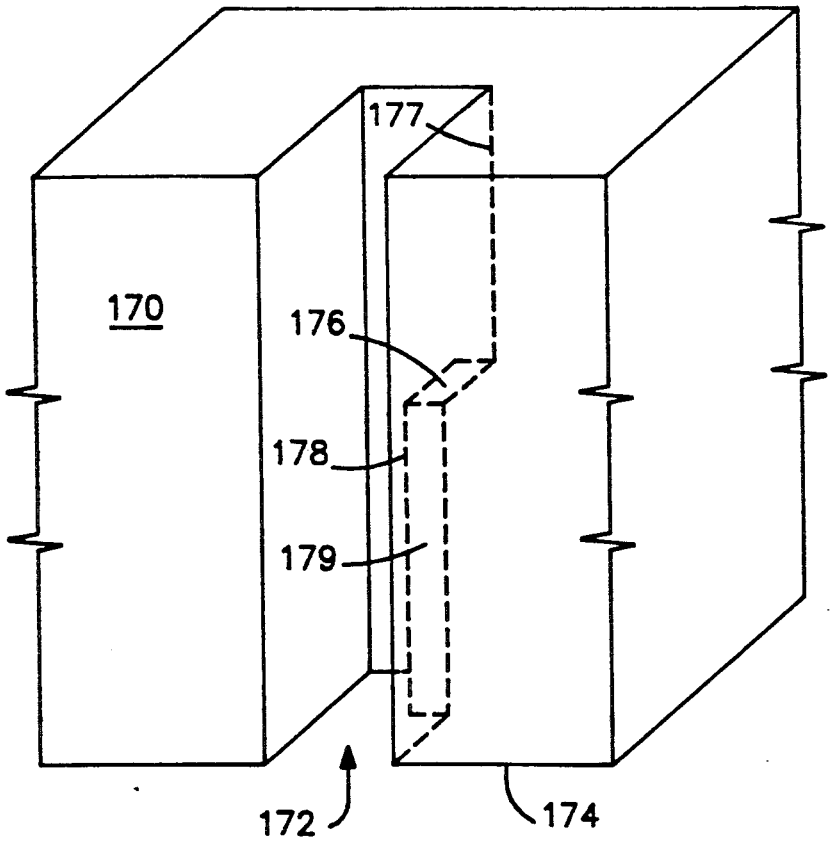
FIG. 8 is a second embodiment of a cross sectional view of a section of a connector housing having a hold-down receiving space for receiving the hold-down terminal of FIG. 3 in accordance with the present invention.

FIG. 8 is a second embodiment of a cross sectional view of a section of a connector housing 170 having a hold-down receiving space 172 for receiving the hold-down terminal 110 of FIG. 3 in accordance with the present invention. The hold-down receiving space 172 illustrated in FIG. 8 is the same as the hold-down receiving space 172 illustrated in FIG. 7 except the space 172 is partially defined by a shoulder surface 176 generally parallel to the mounting face 174 where the shoulder surface 176 does not extend the entire width of the space 172. In this embodiment, the shoulder surface 176 is positioned in a corner 177 of the space 172. This shoulder surface 176 can be described as the top surface of a step which has two other surfaces 178,179 exposed or partially defining the space 172.

Figure 9:
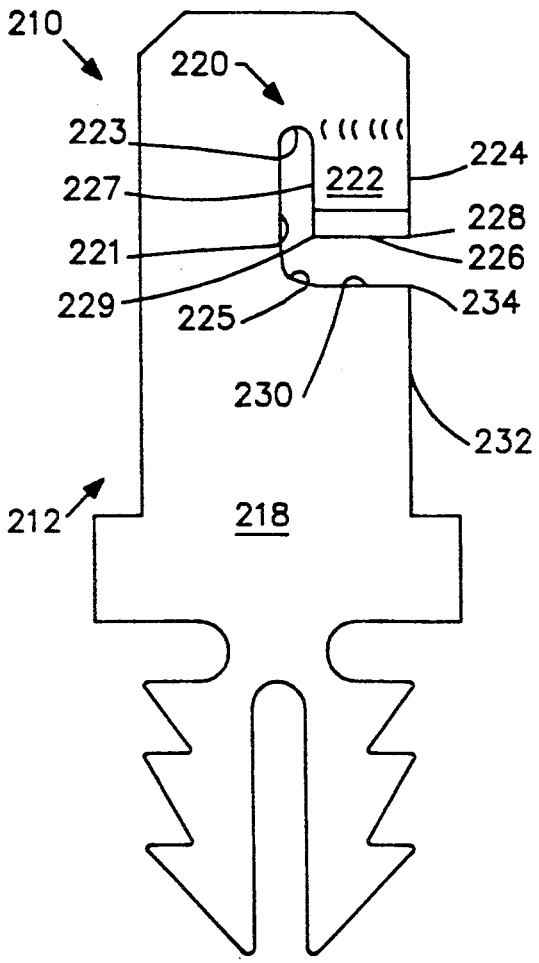
FIG. 9 is a side view of a third embodiment of a hold-down terminal in accordance with the present invention.
Figure 10:
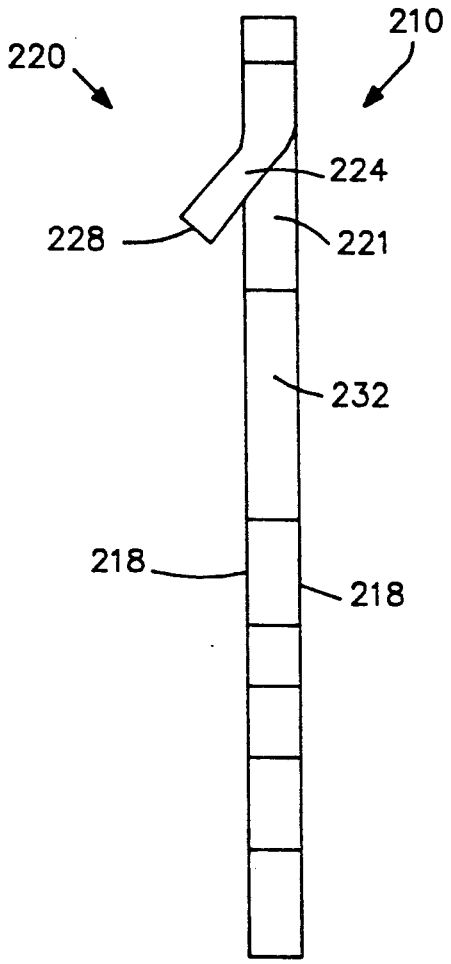
FIG. 10 is an edge view of the hold-down terminal of FIG. 9.

Referring to FIGS. 9 and 10, there is illustrated a third embodiment of a hold-down terminal 210 in accordance with the present invention. This embodiment is the same as the first hold-down terminal 10 except this hold-down terminal 210 has a housing attaching portion 212 which is different than the housing attaching portion 12 of the first hold-down terminal 10. However, like the housing attaching portion 10 of the first hold-down terminal 10, the housing attaching portion 212 of this hold-down terminal 210 fits in and secures to the housing 70 defining the hold-down receiving space 72 illustrated in FIG. 7.

The housing attaching portion 212 has a spring member 220 entirely defined by areas 222 of the pair of opposing sides 218, a first edge surface 224, a second edge surface 226 and a third edge surface 227. The first edge surface 224, the second edge surface 226 and the third edge surface 227 interconnect the opposing side areas 222. The first edge surface 224 intersects the second edge surface 226 forming a first corner 228. The second edge surface 226 intersects the third edge surface 227 forming a second corner 229. In a noncompressed state, the second edge surface 226 extends generally laterally with respect to the remainder of the hold-down terminal 210. In other words, the opposing side areas 222 are bent with respect to the remainder of the opposing sides 218. The housing attaching portion 212 has a fourth edge surface 221 which intersects the third edge surface 227 at a curved junction or intersection 223. The fourth edge surface 221 intersects a fifth edge surface 230 forming a third rounded corner 225. A sixth planar edge surface 232 intersects the fifth edge surface 230 forming a fourth corner 234. In a compressed state where the opposing side areas 222 are forced to be substantially coplanar with the remainder of the opposing sides 218, then (1) the second edge surface 226 faces the fifth edge surface 230 across a gap, (2) the third edge surface 227 faces the fourth edge surface 221 across a gap, and (3) the first edge surface 224 and the sixth edge surface 232 are coplanar and arranged end to end.

The edge surfaces 226, 227, 221 and 230 can be formed by punching a first slug out from a strip of material forming the second edge surface 226 and the fifth edge surface 230. Another slug of material is punched out of the strip forming the third edge surface 227 and the fourth edge surface 221. Then the opposing side areas 222 are bent or molded to the shape of the desired spring member 220.

Figure 11:
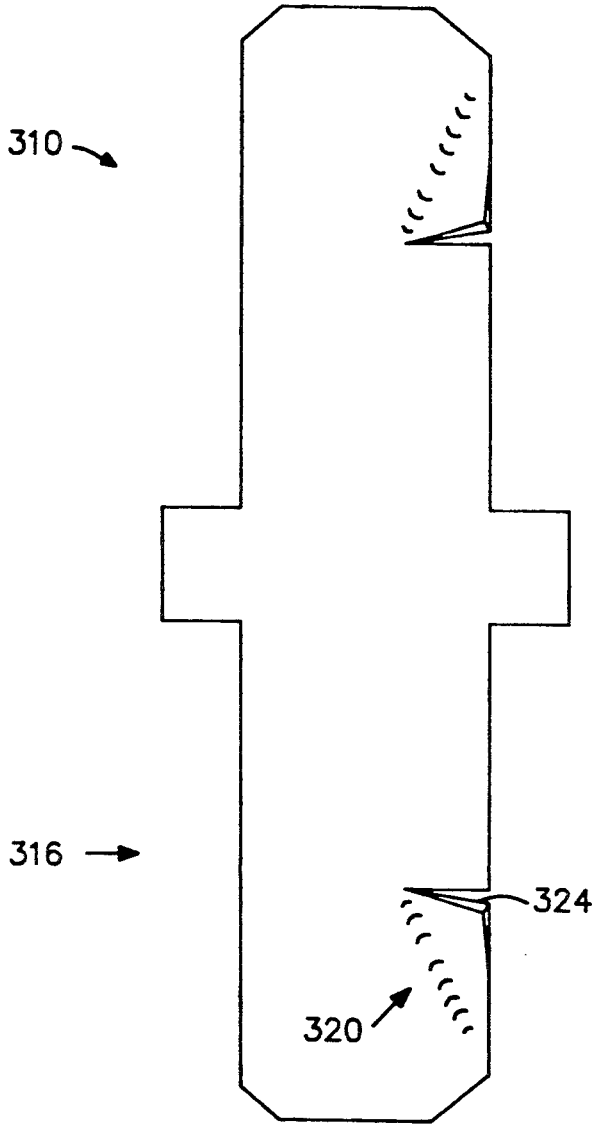
FIG. 11 is a side view of a fourth embodiment of a hold-down terminal in accordance with the present invention.
Figure 12:
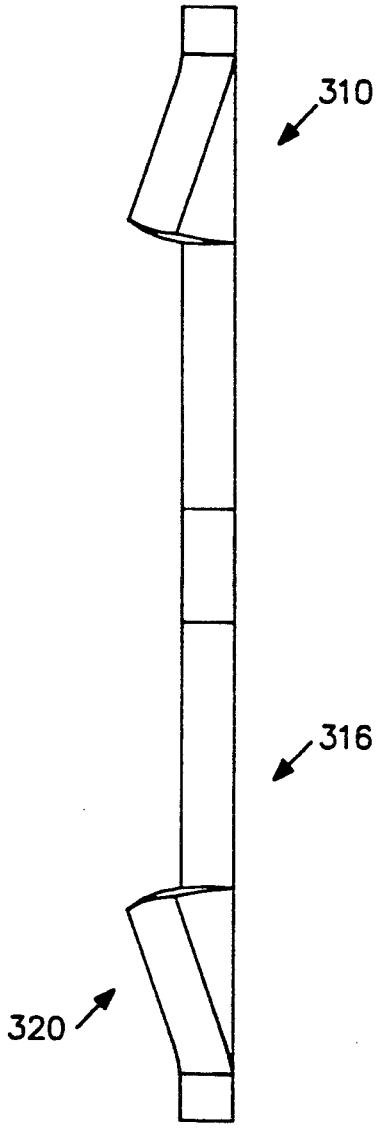
FIG. 12 is an edge view of the hold-down terminal of FIG. 11.

Referring to FIGS. 11 and 12, there is illustrated a hold-down terminal 310 just like the first hold-down terminal 10 except this hold-down terminal 310 has a circuit assembly attaching portion 316 which is a mirror image of the housing attaching portion 12 of the first hold-down terminal 10. With this hold-down terminal 310 when the circuit assembly attaching portion 316 is inserted in a hole through the circuit assembly, the assembly compresses a spring member 320 of the circuit assembly attaching portion 316 until an end surface 324 of the spring member 320 of the circuit assembly attaching portion 316 springs out of the assembly hole below and onto a surface of the circuit assembly. The cross section of the assembly hole would preferably be rectangular.

It should be noted that another hold-down terminal in accordance with the present invention is configured to have two mirror image end sections such that the housing attaching portion is as illustrated in FIGS. 3–6 and the circuit assembly attaching portion is its mirror image. Another hold-down terminal in accordance with the present invention is configured to have two mirror image end sections such that the housing attaching portion is as illustrated in FIGS. 9 and 10 and the circuit assembly attaching portion is its mirror image.

Alternatively, it is within the scope of the present invention to make a hold-down terminal with any one of the housing attaching portions disclosed herein connected to a stand-off which in turn is connected to any one of the circuit assembly attaching portions disclosed herein.

The housing attaching portions disclosed herein will allow an easy release of the housing attaching portion from the connector housing and when used as a circuit assembly attaching portion will allow an easy release of the circuit assembly attaching portion from the circuit assembly. Thus, they can be used to hold down a connector to a circuit assembly and they also allow parts to be removed to permit repairs or exchange of parts. The hold-down terminals disclosed herein require a minimum of space in the connector housing and on the circuit assembly surface.

Figure 13:
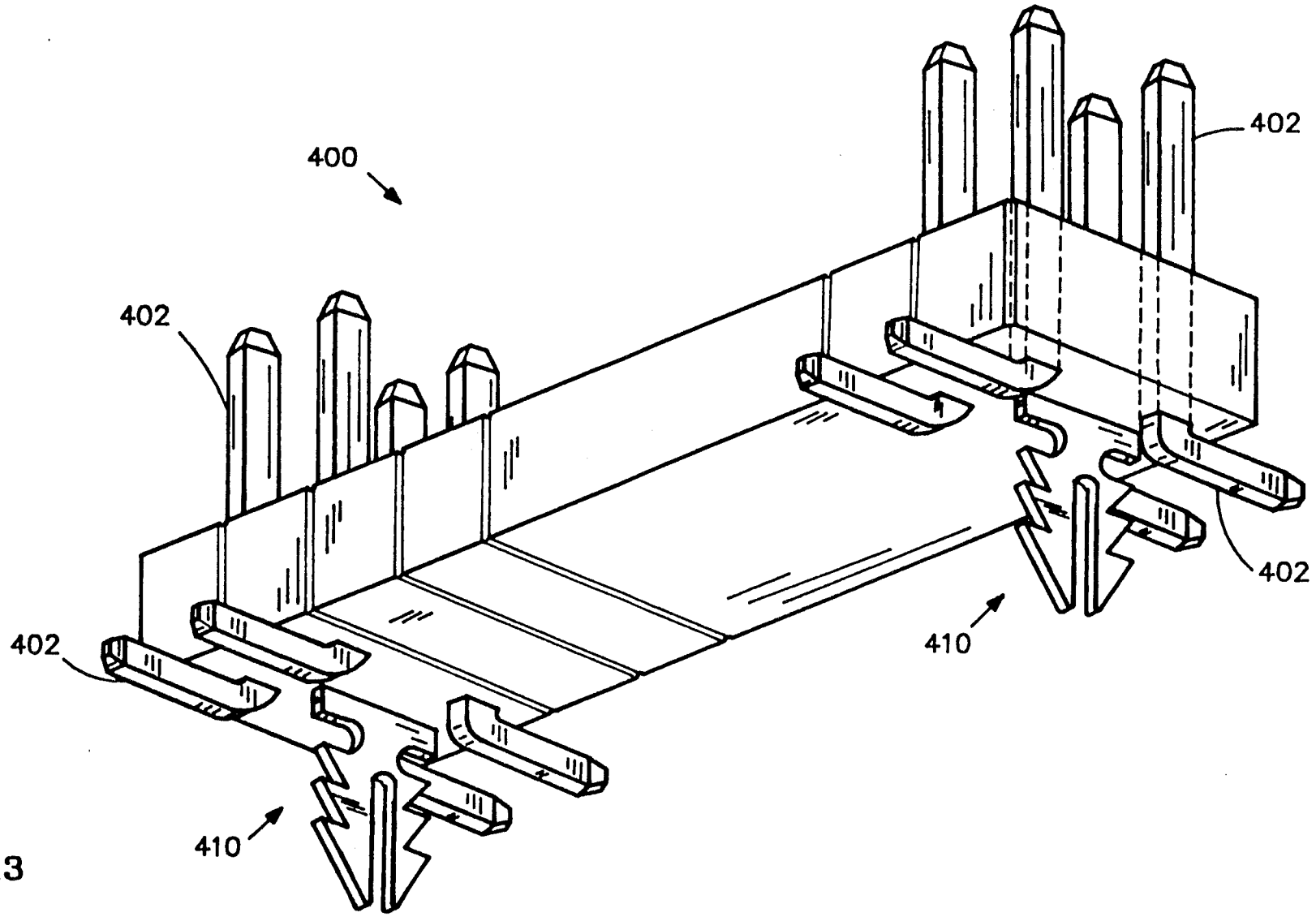
FIG. 13 is a perspective view of a connector having surface-mount terminal pins and hold-downs terminals in accordance with the present invention.

The hold-down terminals of the present invention can be used to secure surface-mount connectors or through mount connectors to circuit assemblies. In either case, the hold-downs of the present invention can be used to ground the connector to the assembly. Typically, the hold-down terminals will be in addition to and distinct from the electrical contact elements used as single paths. FIG. 13 is a perspective view of a connector 400 having surface-mount terminal pins 402 and hold-downs terminals 410 in accordance with the present invention which are distinct from the surface mount pins or contact elements 402.

The hold-downs terminals or hold-downs of the present invention can be made from any suitable metal used for making hold-downs, such as stainless steel. Further, the hold-downs can be made from any suitable metal used for making electrical terminals, such as brass, phosphor bronze, beryllium copper and the like. The hold-down may be plated or coated with a layer, such as tin, lead, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A hold-down terminal for holding a connector housing to a circuit assembly, the housing having a mounting face and a hold-down receiving space recessed in the mounting face, the space partially defined by a shoulder surface generally parallel to the mounting face, the hold-down terminal comprising:

a housing attaching portion having a spring member with a first edge surface such that when the housing attaching portion is inserted in the space recessed in the housing, the housing compresses the spring member until the end surface springs onto the shoulder surface partially defining the space;

a circuit assembly attaching portion for securing to the circuit assembly;

a stand-off between the housing attaching portion and the circuit assembly attaching portion, the stand-off having opposed surfaces for facing the housing and the circuit assembly and for ensuring a space between the housing and the circuit assembly to limit wicking during soldering and to allow cleaning; and wherein the circuit assembly attaching portion comprises a pair of spring members generally parallel to one another and spaced entirely apart by a slot except the spring members are connected together at and extend from the stand-off, the spring members having outer sides comprising easy insertion ramps with barbs at outer ends of the ramps such that the ramps allow easy insertion forming an interference fit in a hole through the circuit assembly, but the barbs dig into the circuit assembly if the hold-down terminal is withdrawn from the hole.

2. The hold-down terminal of claim 1, wherein the housing attaching portion, the circuit assembly attaching portion and the stand-off are one-piece.

3. The hold-down terminal of claim 1, wherein one of the opposing surfaces of the stand-off provides a stop for contacting the housing and preventing further insertion of the hold-down terminal into the hold-down receiving space.

4. The hold-down terminal of claim 1, wherein the housing attaching portion, the circuit assembly attaching portion and the stand-off have opposed sides entirely in a pair of parallel planes, except the spring member has opposed side areas that are substantially in the parallel planes when the spring member is in a compressed state and that are not in the parallel planes when the spring member is in a noncompressed state.

5. The hold-down terminal of claim 4, wherein in the compressed state the end surface of the spring member is spaced from the remainder of the housing attaching portion.

6. The hold-down terminal of claim 4, wherein the spring member has a second edge surface and a third edge surface and in the compressed state the first, second and third edge surfaces of the spring member are spaced from the remainder of the housing attaching portion.

7. The hold-down terminal of claim 1, wherein the spring member has a U shaped cross section in its noncompressed state.

8. The hold-down terminal of claim 1, wherein the housing attaching portion comprises a flat strip having a first side and a second side folded upon itself forming a first portion, a second portion and an elbow portion interconnecting the first portion and the second portion, the second portion comprises a first section and a second section partially divided forming a first edge surface on the first section and a second edge surface on the second section, the first side of the first portion substantially contacting the first side of the second portion except the first edge surface extends away from the first portion forming the end surface of the spring member.

9. An electrical connector for mounting to a circuit assembly, comprising:

a dielectric housing having a mounting face and a hold-down receiving space recessed in the mounting face, the space partially defined by a shoulder surface generally parallel to the mounting face; and a hold-down terminal having:

a housing attaching portion having a spring member with an end surface such that when the housing attaching portion is inserted in the space recessed in the housing, the housing compresses the spring member until the end surface springs onto the shoulder surface partially defining the space;

a circuit assembly attaching portion for securing to the circuit assembly; and a stand-off between the housing attaching portion and the circuit assembly attaching portion, the stand-off extending beyond the housing and having opposed surfaces for facing the housing and the circuit assembly for ensuring a space between the housing and the circuit assembly to limit wicking during soldering and to allow cleaning.

10. The electrical connector of claim 9, wherein the housing attaching portion, the circuit assembly attaching portion and the stand-off are one-piece.

11. The electrical connector of claim 9, wherein the circuit assembly attaching portion comprises a pair of spring members generally parallel to one another and spaced entirely apart by a slot except the spring members are connected together at and extend from the stand-off, the spring members having outer sides comprising easy insertion ramps with barbs at outer ends of the ramps such that the ramps allow easy insertion forming an interference fit in a hole through the circuit assembly, but the barbs dig into the circuit assembly if the hold-down terminal is withdrawn from the hole.

12. The electrical connector of claim 9, wherein one of the opposing surfaces of the stand-off provides a stop for contacting the housing and preventing further insertion of the hold-down terminal into the hold-down receiving space.

13. The electrical connector of claim 9, wherein the housing attaching portion, the circuit assembly attaching portion and the stand-off have opposed sides entirely in a pair of parallel planes, except the spring member has opposed side areas that are substantially in the parallel planes when the spring member is in a compressed state and that are not in the parallel planes when the spring member is in a non-compressed state.

14. The electrical connector of claim 13, wherein in the compressed state the end surface of the spring member is spaced from the remainder of the housing attaching portion.

15. The electrical connector of claim 13, wherein the spring member has a second edge surface and a third edge surface and in the compressed state the first, second and third edge surfaces of the spring member are spaced from the remainder of the housing attaching portion.

16. The electrical connector of claim 9, wherein the spring member has a U shaped cross section in its non-compressed state.

17. The electrical connector of claim 9, wherein the housing attaching portion comprises a flat strip having a first side and a second side folded upon itself forming a first portion, a second portion and an elbow portion interconnecting the first portion and the second portion, the second portion comprises a first section and a second section partially divided forming a first edge surface on the first section and a second edge surface on the second section, the first side of the first portion substantially contacting the first side of the second portion except the first edge surface extends away from the first portion forming the end surface of the spring member.

18. The hold-down of claim 9, wherein the circuit assembly attaching portion comprises a mirror image of the housing attaching portion such that when the circuit assembly attaching portion is inserted in a hole through the circuit assembly, the assembly compresses a spring member of the circuit assembly attaching portion until an end surface of the spring member of the circuit assembly attaching portion springs out of the assembly hole onto a surface of the circuit assembly.

* * * * *